United States Patent [19]

Aoyama et al.

[11] 4,387,673

[45] Jun. 14, 1983

[54] VALVE OPENING CONTROL DEVICE

[75] Inventors: Shunichi Aoyama, Yokohama; Eiji Murata, Yokosuka, both of Japan

[73] Assignee: Nissan Motor Co., Ltd., Yokohama, Japan

[21] Appl. No.: 159,324

[22] Filed: Jun. 13, 1980

[30] Foreign Application Priority Data

Jun. 14, 1979 [JP] Japan ..... 54-74994

[51] Int. Cl.[3] ..... F01L 1/34

[52] U.S. Cl. ..... 123/90.16; 123/90.39; 137/505.26

[58] Field of Search ..... 123/90.12, 90.13, 90.16, 123/90.15, 90.39, 90.41, 90.45, 90.46, 90.55, 123/454, 457, 460, 462, 511; 137/505.18, 505.21, 137/505.22, 505.26, 505.42, 514.7

[56] References Cited

U.S. PATENT DOCUMENTS

| | | | |
|---|---|---|---|
| 2,880,711 | 4/1959 | Roan | 123/90.16 |
| 2,954,017 | 9/1960 | Forstner | 123/90.16 |
| 2,997,991 | 8/1961 | Roan | 123/90.16 |
| 4,089,343 | 5/1978 | Ishida | 137/505.26 |
| 4,218,995 | 8/1980 | Aoyama | 123/90.16 |
| 4,258,671 | 3/1981 | Takizawa et al. | 123/90.16 |

FOREIGN PATENT DOCUMENTS

| | | | |
|---|---|---|---|
| 155605 | 3/1954 | Australia . | |
| 209542 | 7/1957 | Australia . | |
| 52-6813 | 1/1977 | Japan | 123/90.12 |
| 1201872 | 8/1970 | United Kingdom . | |
| 1431562 | 4/1976 | United Kingdom | 137/505.26 |

OTHER PUBLICATIONS

Stockel, M. W. *Auto Mechanics Fundamentals*, Ill., Goodheart-Willcox, Chapter 7, p. 157, No Date Given.

*Primary Examiner*—Craig R. Feinberg
*Assistant Examiner*—W. R. Wolfe
*Attorney, Agent, or Firm*—Thompson, Birch, Gauthier & Samuels

[57] ABSTRACT

A valve opening control device for use with an internal combustion engine having cam-operated cylinder valves comprises a cam-like member having a cylindrical surface concentric with a shaft about which the member rotates and a cam-like section extending tangentially therefrom. The control device shaft is positioned parallel to and adjacent a rocker arm shaft or otherwise perpendicular to the axis of travel of the cylinder valve and/or the plane defined by such axis of travel and the plane of travel of a cylinder valve rocker arm for such valve. The valve opening control device transmits an opening force from the rotating engine camshaft for a distance which is progressively proportional to the distance the valve lifter travels in response to the rotating engine camshaft.

The amount of rotational displacement of the control device is regulated by a hydraulic valve lifter, the effective length thereof being regulated by fluid pressure such that a higher fluid pressure increases the effective length thereof, causing the cylinder valve to be open through a larger degree of camshaft rotation and for a greater maximum distance. This fluid pressure is regulated indirectly by the relative position of the engine throttle, so that higher throttle settings increase the fluid pressure to the hydraulic valve lifter to cause the cylinder valve to be open a greater distance and for a longer period of time.

5 Claims, 6 Drawing Figures

VALVE OPENING CONTROL DEVICE

BACKGROUND OF THE INVENTION

1. Field of the Invention

The present invention relates generally to a device for controlling the opening of a cam operated cylinder head valve, and more specifically to a device positioned between the rotating cam and the cylinder valve for opening the cylinder valve by an amount progressively proportional to the amount of lift provided by the cam lobe.

2. Description of the Prior Art

Various devices have been used in internal combustion engines for controlling the amount of opening of a cylinder valve with respect to the amount of lift provided by the rotating camshaft, generally as a function of engine oil pressure, which in turn, is a function of engine rotational speed (R.P.M.). The theory behind this type of hydraulic valve lifter is to use "incompressible" engine oil to control the amount of lift of the lifter with respect to the cam lobe. Of course, due to the shape of a cam lobe, the point in time (degree of rotation of the camshaft) may also be regulated to control the "timing" at which the cylinder valve opens and closes.

However, such devices have not been able to compensate for the necessary abrupt transition between the camshaft concentric surface and cam lobe. Such abrupt transitions have resulted in unnecessary impact between the cylinder valve and valve seat, sometimes accompanied by valve "bounce", contributing to impaired engine performance.

SUMMARY OF THE INVENTION

The valve opening control device of the present invention comprises a cam-like member, rotationally mounted on a shaft and so positioned to transfer opening force from a rotating internal combustion engine cam to a cylinder valve thereof. The control device receives opening force for a specified distance of travel, and transmits this force to the cylinder valve to open the valve by an amount which is progressively proportional to the amount the control device pivots in response to the force from the engine cam. The opening device is designed such that the instantaneous rate of opening of the cylinder valve is directly proportional to the amount of pivot of the device.

The control device of the present invention includes an outer surface concentric with the shaft on which it rotates, a second cam-like section defining a first cam-like surface extending tangentially therefrom and a third transition section at the tangential point of contact of the two. When the opening force is transmitted via the control device to the cylinder valve at a point along the concentric surface, pivoting of the control device has no effect on opening of the cylinder valve. Only when the point of force transmission is along the second cam-like surface will pivoting of the control device open the cylinder valve. The initial point of transmission of this valve opening force along the control device is regulated by fluid pressure supplied to a hydraulic valve lifter which transmits the opening force from the engine cam to the control device. In this manner, by controlling fluid pressure to the hydraulic valve lifter, the amount and timing of opening of the cylinder valve can be regulated.

BRIEF DESCRIPTION OF THE DRAWINGS

The features and advantages of the valve opening control device of the present invention will be more clearly appreciated from the following description taken in conjunction with the accompanying drawings in which like reference numerals designate corresponding elements, and in which:

FIG. 3(*b*) is a view similar to FIG. 3(*a*), showing the cylinder valve full-open position;

FIG. 3(*c*) is a view similar to FIGS. 3(*a*)–(*b*), showing the cylinder valve full-closed position.

DESCRIPTION OF THE PREFERRED EMBODIMENT

Figure 1:
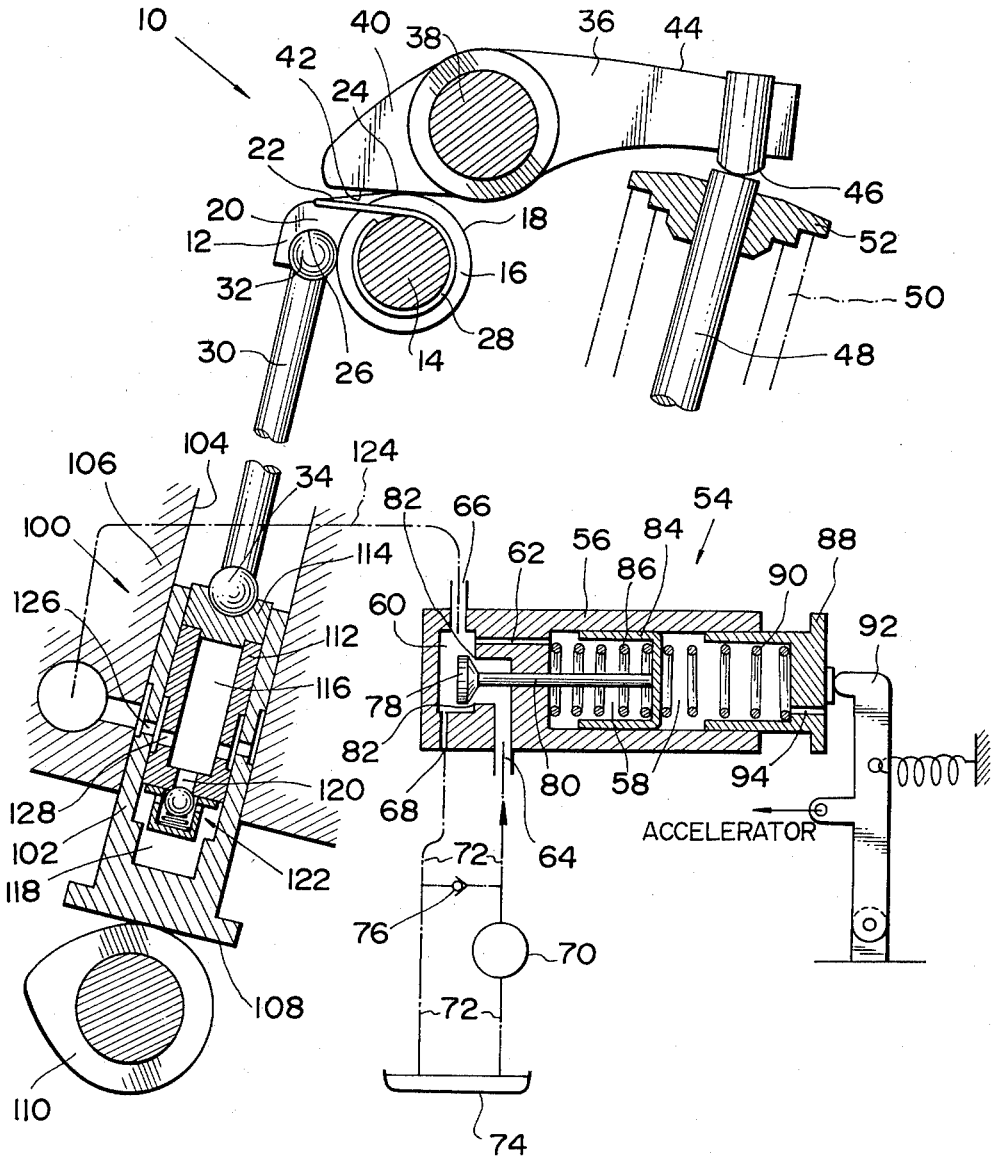
FIG. 1 is a diagrammatical view of the valve opening control device of the present invention showing a conventional hydraulic valve lifter associated therewith in vertical section, and also showing, in vertical section, a fluid pressure regulating valve for use therewith.

Turning now to the drawings, and more specifically to FIG. 1, the valve opening control device of the present invention is shown generally illustrated by the numeral 10. The control device 10 comprises a cam-like member 12 mounted to rotate about a shaft 14 adjacent a rocker arm 36 to engage same to open a cylinder valve (not shown). The cam-like member 12 includes a first section 16 defined by an outer concentric surface 18, and a second section 20 to define a first cam-like surface 22 extending tangentially from the first section outer concentric surface 18 and a second section push rod engaging surface 26 opposite thereto. Also included is a transition section 24 at the tangential point on the outer surface of the cam-like member 12 where the outer concentric surface 18 joins the first cam-like surface 22. In the preferred embodiment, the second section second engaging surface 26 takes the form of a semispherical depression to accommodate a spherical shaped end 32 of a rocker arm push rod 30. The preferred embodiment also includes a spring 28 fixed to and mounted around the control device shaft 14 and positioned to urge the device in a rotational direction opposite that for opening the cylinder valve (counter clockwise as shown in the drawings).

Figure 2:
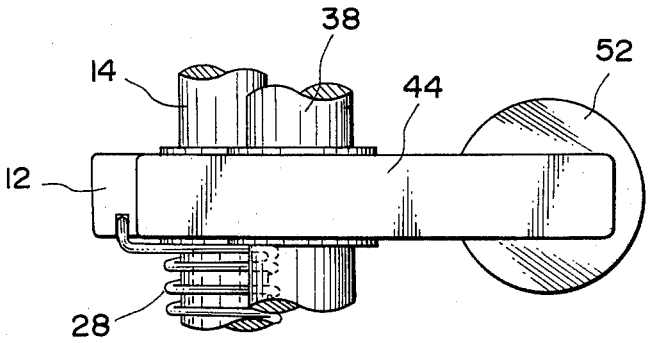
FIG. 2 is a top view of a cylinder valve rocker arm assembly incorporating the valve opening control device of the present invention.

As shown, the valve opening control device 10 is positioned adjacent the rocker arm 36 in order to engage the rocker arm to open the cylinder valve. As best shown in FIG. 2, in the preferred embodiment, the control device shaft 14 is positioned adjacent and parallel to a rocker arm shaft 38 to enable the control device 10 and rocker arm 36 to pivot in the same plane. The rocker arm 36 includes a first lobe 40 having a force receiving surface 42 adapted to engage the cam-like member 12. The rocker arm is pivoted to open the cylinder valve. A rocker arm second lobe 44 includes a valve stem engaging surface 46 for engaging a cylinder head valve stem 48 to open the valve. Also shown are a conventional valve spring 50 and valve keeper 52.

Also shown in FIG. 1 is a fluid pressure regulating valve 54 for use with the valve opening control device of the present invention. The regulating valve 54 includes a valve body 56 having a first open chamber 58 and a second closed chamber 60. A passageway 62 provides fluid communication between the first and second chambers 58 and 60. The second chamber 60 also includes an inlet port 64, an outlet port 66 and a return port 68. The inlet port 64 and return port 68 are connected to a fluid pump 70 via fluid connections 72 to supply pressurized fluid (i.e. engine oil) to the regulating valve second chamber 60. Also included is a fluid reservoir 74 (engine oil pan) for supplying fluid to the fluid pump 70, and a check valve 76 positioned between the fluid connections 72 to the inlet port 64 and return port 68 to prevent pressurized fluid from entering the regulating valve second chamber 60 through the return port, 68 and also to prevent the pressurized fluid from returning directly to the fluid reservoir 74.

The fluid pressure regulating valve 54 includes a valve element 78 having a valve stem 80 projecting into the first chamber 58 from the second chamber 60. The valve element 78 seals against a valve seat 82 formed in the second chamber 60 to interrupt communication between the inlet port 64 (i.e. the fluid pump 70) and the second chamber 60 to prevent pressurized fluid from flowing through the regulating valve 54.

A first piston 84 is positioned within the first open chamber 58 and is fixed to the valve stem 80 to operate the valve element 78, thereby controlling the amount of pressurized fluid flowing into the regulating valve 54. A first spring 86 is positioned within the first chamber 58 to urge the first piston 84 in a direction to seal the valve element 78 against the valve seat 82.

The regulating valve 54 also includes a second piston 88 positoned in the first open chamber 58. A second spring 90 is positioned between the first and second pistons 84 and 88 so that an external actuator 92 acting against the second piston imparts an adjustable spring force against the first piston in a direction to urge the valve element 78 to open, against the force of the first spring 86. A pressure equalizing bleed passageway 94 is included in the second piston 88 to equalize the pressure within and without the section of the first chamber 58 between the pistons so that the force exerted by the second piston 88 upon the first piston 84 will be only that of the second spring 90.

A cam-actuated hydraulic valve lifter 100 is also shown in FIG. 1 for use with the valve opening control device of the present invention. It comprises a body 102 positioned within a valve lifter bore 104 within the engine cylinder block 106. The hydraulic valve lifter 100 includes a cam engaging surface 108 for engaging an engine cam 110 in the conventional manner. The lifter body 102 includes a hollow plunger 112 positioned for axial movement therein. A push rod cap 114 is positioned within the valve lifter body 102 above the hollow plunger 112 to define a first pressure chamber 116 within the hollow plunger. The push rod cap 114 includes a semispherical depression similar to that of the cam-like member second section engaging surface 26 for receiving a second spherical end 34 of the rocker arm push rod 30.

The hollow plunger 112 is so positioned within the valve lifter body 102 to define a second pressure chamber 118 communicating with the first pressure chamber 116 via a feed passage 120, and a check valve (ball and spring device) 122 is provided for permitting fluid flow only in one direction, from the first pressure chamber to the second pressure chamber.

Conventional fluid connections 124 provide pressurized fluid (i.e. engine oil) from the fluid pressure regulating valve 54 to the hydraulic valve lifter 100. This pressurized fluid enters the hydraulic valve lifter 100 via lifter 100 body fluid inlets 126 and plunger fluid inlets 128 to enable the hydraulic valve lifter to function with the valve opening control device 10 of the present invention to be described hereinbelow.

Figure 3A:
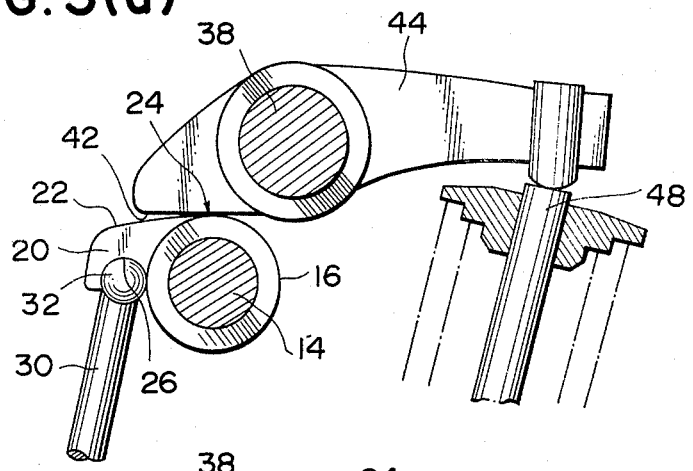
FIG. 3(*a*) is a side view of a rocker arm assembly incorporating the valve opening control device of the present invention, the control device and rocker arm shown in the position of initial opening of the cylinder valve.
Figure 3B:
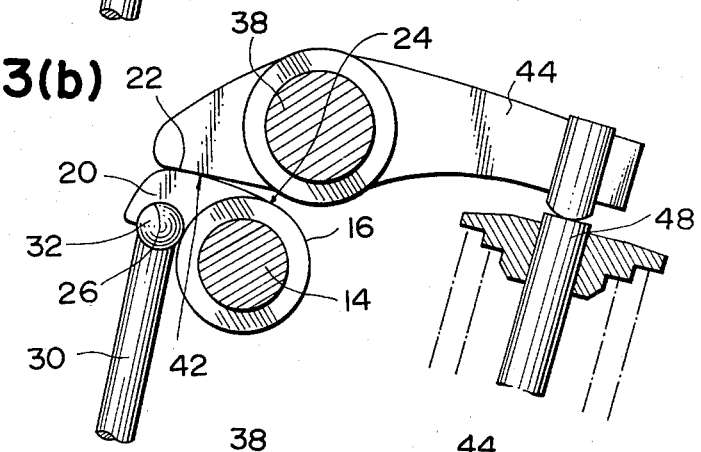
Figure 3C:
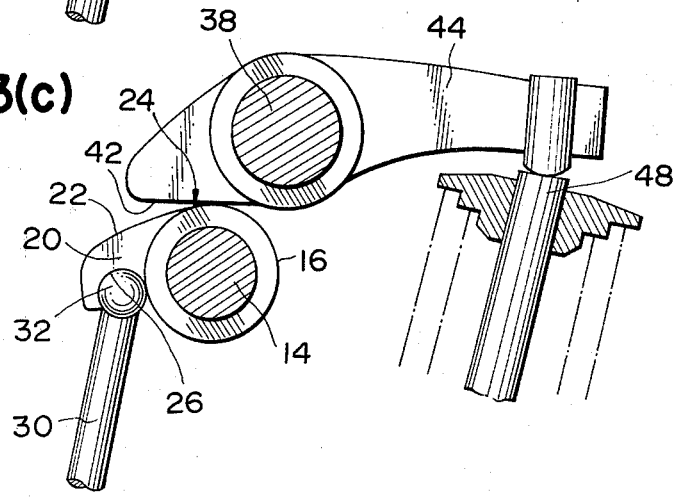

In operation, the valve opening control device 10 of the present invention functions to transmit an opening force to the cylinder valve, causing the valve to open a prescribed amount, such amount being progressively proportional to the amount of pivot of the device. Alternatively stated, the instantaneous rate of opening of the cylinder valve is proportional to the instantaneous amount the valve lifter 100 is raised. As shown in FIG. 3(*a*), the control device transition section 24 contacts the rocker arm force receiving surface 42 to initiate opening of the cylinder valve (not shown). The control device first cam-like surface 22 is so designed to mate with the rocker arm force receiving surface 42 to cause the rocker arm 36 to pivot clockwise an amount progressively proportional to the amount of pivot of the control device 10 as the control device pivots clockwise and the point of contact between the control device first cam-like surface 22 and the rocker arm force receiving surface 42 moves along their respective surfaces toward the outer edge (to the left as shown in FIG. 3). Those skilled in the art will readily appreciate that the valve opening control device 10 of the present invention causes the cylinder valve (not shown) to open an amount which is progressively proportional to the amount of axial travel of rocker arm push rod 30. At any point in time when the point of contact between the control device 10 and the rocker arm 36 is along the control device first cam-like surface 22, the rate of opening of the cylinder valve is directly proportional to the amount of axial travel of the push rod 30. Therefore, it will be appreciated that, during the initial stage of cylinder valve opening (and of course, as the cylinder valve closes), the rate of opening (and closing) of the cylinder valve is much lower than that obtained by conventional systems employing only rocker arm systems to open and close the cylinder valves. It should be noted that the rate of opening of the cylinder valve is greatest when the valve is fully open, i.e. when the point of contact between the control device 10 and the rocker arm force receiving surface 42 is furthest from the control device shaft 14 and rocker arm shaft 38 (left-most position as shown in drawings). Those skilled in the art will also appreciate that due to the design of the valve opening control device 10 of the present invention, since the point of contact between the control device and the rocker arm force receiving surface 42 always travels between a first plane defined generally by the axis of movement of the rocker arm push rod 30 parallel to the axis of rotation of the control device, and a second plane through the axis of rotation of the control device and parallel to the first plane, the ratio of the amount of opening of the cylinder valve to the amount of axial travel of the rocker arm 36 is never greater than 1:1. Therefore, it is virtually impossible for the cylinder valve to be opened by an amount greater than that obtained without the use of the control device of the present invention, thus preventing damage to the internal combustion engine by contact between the cylinder valve and piston (not shown).

As shown in FIG. 3(*c*), it is possible to adjust the valve opening control device 10 of the present invention to cause the cylinder valve to remain closed for a prescribed time while the rocker arm push rod 30 is in its initial stage of ascent. This is accomplished by lowering the point of initial ascent of the push rod 30 so that the point of contact between the rocker arm force receiving surface 42 and the control device 10 is along a prescribed arc of the control device outer concentric surface 18. Those skilled in the art will readily appreciate that as this point of contact moves along the outer concentric surface 18 as the push rod 30 is in its initial stage of ascent, the control device 10 will not cause the rocker arm 36 to open the cylinder valve. It will therefore be understood that the point in time at which the cylinder valve begins to open (and of course, closes) with respect to the point in time at which the hydraulic valve lifter 100 engages the lobe of the rotating cam 110, may be controlled by regulating the position at which the push rod 30 begins its initial ascent. It will be appreciated that the amount the cylinder valve is opened may also be controlled by regulating the position at which the push rod 30 begins its initial ascent.

The hydraulic valve lifter 100, shown in FIG. 1, is of a type whereby the effective length thereof is controllable within a certain range, and is directly proportional to a fluid pressure introduced at the lifter body fluid inlets 126. Briefly, the operation of the valve lifter 100 is such that a hydraulic pressure (engine oil) enters the valve lifter through the lifter body and plunger fluid inlets 126 and 128. If such pressure is sufficient to overcome the compression spring of the check valve 122, engine oil is urged through the passage 120, through the check valve and into the second pressure chamber 118, to force the hollow plunger 112 upwardly with respect to the valve lifter body 102, against the action of the valve opening control device spring 28 tending to urge the control device in a counter clockwise direction to force the valve lifter 100 downwardly. In the preferred embodiment, the force of this spring 28 is minimal, only sufficient to urge the control device 10 toward the valve lifter 100 to automatically take up any clearance that would otherwise exist between the control device and valve lifter. Therefore, only a slight increase in fluid pressure is required to pivot the control device 10 clockwise so that the point of contact between the rocker arm force receiving surface 42 and the control device is at the transition point 24 thereof. It will readily be appreciated that, when the effective length of the valve lifter 100 is thus increased by fluid pressure, the maximum amount of valve opening and maximum time of valve opening is obtained.

The fluid pressure regulating valve 54 of the present invention functions to control this fluid pressure (engine oil) supply to the valve lifter 100 to thereby regulate the timing and the amount the cylinder valve is open as a function of the position of an external actuator 92, typically connected to the vehicle accelerator pedal. In the regulating valve 54 shown in FIG. 1, the valve element 78 is normally closed, it being urged by the first spring 86 to seal against the valve seat 82 to preclude the flow of pressurized fluid (engine oil) into the second chamber 60 and eventually to the valve lifter 100. As the accelerator throttle opens, the external actuator 92 urges the second piston 88 to the left as shown in the drawing, to transmit a compressive spring force to the first piston 84 tending to urge the piston in a direction to open the valve element 78 against the action of the first spring 86. Therefore, at a prescribed amount of throttle opening, the regulating valve 54 opens, permitting fluid pressure (engine oil) to pass therethrough to the valve lifter 100. It should be noted that the regulating valve 54 includes means for limiting the amount of the fluid pressure supplied to the valve lifter 100. The second chamber 60 communicates with the first chamber 58 via the communicating passageway 62 so that, at all times fluid pressure in each of the passages remains the same. Upon the introduction of excessive fluid pressure into the second chamber 60, and thus the first chamber 58 via passageway 62, this pressure acts against the first piston 84 to urge it rightwardly in the drawing, to close the valve element 78 preventing further fluid flow therethrough. Thus, excessive fluid pressure to the valve lifter 100 which would otherwise tend to extend the effective length of the valve lifter beyond a predetermined maximum safe length, is prevented.

Figure 4:
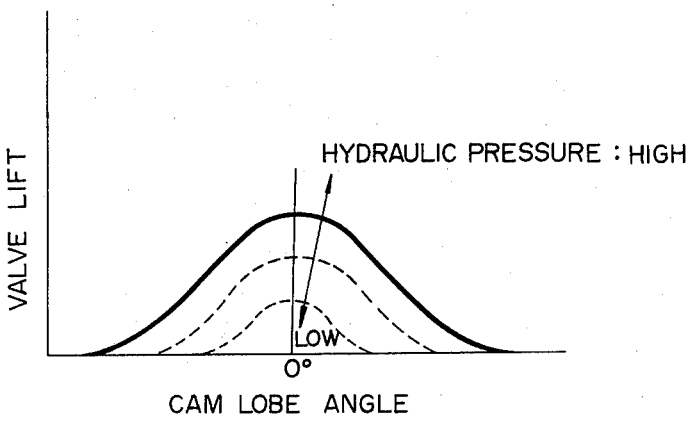
FIG. 4 is a hydraulic pressure/valve lift graph showing the operational characteristics of the valve opening control device of the present invention.

Since the amount (distance) of valve opening is progressively proportional to the amount (distance) of lift of the valve lifter, at the initial stages of valve opening, the opening force is transmitted by the control device first cam-like surface 22 near the transition section 24 where the ratio of valve opening distance to valve lifter travel is low. As the point of lift force (the point of contact between the rocker arm force receiving surface 42 and the control device cam-like member 12) moves along the cam-like surface 22 away from the transition section, this ratio increases and the valve opens a progressively greater distance for a given distance of cam lifter lift distance. This results in a two-fold advantage:

(1) at the opening and closing of the cylinder valve, the rate of travel of the valve is low, resulting in a buffered opening and closing. This resulting smooth cylinder valve opening and seating reduces the impact force on all associated moving parts and prevents valve bounce because such movement is gradual; and (2) the cylinder valve opening amount and timing can be controlled by oil pressure. As shown in FIG. 4, at a low oil pressure, the point of contact between the rocker arm force receiving surface 42 and the control device 10 is along a prescribed arc of the outer concentric surface 18, resulting in a certain amount of valve lifter lift having no effect on the cylinder valve opening. Therefore, the valve opens at a later point in time and is open for a shorter period of time under a lower hydraulic pressure. Even under this condition, there is no valve noise, because the contact between the control device 10 and the rocker arm 36 is gradual, as opposed to conventional push rod/rocker arm systems.

Conversely, at a high oil pressure, the initial point of contact between the rocker arm force receiving surface 42 and the control device 10 is at the transition section 24 and travels a further distance along the control device first cam-like surface 22, causing the valve to open immediately upon initial rising of the valve lifter. Therefore, the valve opens at an earlier point in time and is open for a longer period of time under a higher hydraulic pressure.

There has been provided a valve opening control device in accordance with the present invention that satisfies all of the aims and objectives set forth hereinabove. It should be understood that further modifications and variations may be made in the present invention without departing from the spirit of the present invention as set forth in the appended claims.

What is claimed is:

1. A fluid pressure regulating valve for regulating a fluid pressure in response to the position of an external actuator, said valve comprising:

(a) a body having
  (I) a first chamber,
  (II) a second chamber,
  (III) a passageway providing communication between said first and second chambers,
  (IV) an inlet port communicating with said second chamber,
  (V) an outlet port communicating with said second chamber, and
  (VI) a return port communicating with said second chamber;

(b) a valve element positioned within said second chamber for regulating communication between said second chamber and said inlet port;

(c) a first piston positioned within said first chamber for controlling the operation of said valve element;

(d) a second piston positioned within said first chamber for controlling the operation of said first piston;

(e) a first spring positioned within said first chamber for urging said first piston in a direction to cause said valve element to close said inlet port; and (f) a second spring positioned between said first and second pistons to urge said pistons in opposite directions, whereby a force applied to said second piston increases the second spring compressive force tending to urge said first piston in a direction to cause said valve element to open said inlet port, against the action of said first spring, for introducing a pressurized fluid into said second chamber, whereupon such fluid pressure acts via said body passageway against said first piston to urge said first piston in a direction to close said inlet port, against the action of said second spring.

2. A system for regulating the opening of an internal combustion engine cam-operated cylinder valve in response to the position of an external actuator, said system comprising:

(a) a fluid pump;

(b) a fluid pressure regulating valve for regulating the the fluid pressure from said fluid pump in response to the position of an external actuator, said valve comprising:
  (I) a body having
    A. a first chamber,
    B. a second chamber,
    C. a passageway providing communication between said first and second chambers,
    D. an inlet port communicating with said second chamber and with said fluid pump,
    E. an outlet port communicating with said second chamber, and
    F. a return port communicating with said second chamber;
  (II) a valve element positioned within said second chamber for regulating communication between said second chamber and said inlet port;
  (III) a first piston positioned within said first chamber for controlling the operation of said valve element;
  (IV) a second piston positioned within said first chamber for controlling the operation of said first piston;
  (V) a first spring positioned within said first chamber for urging said first piston in a direction to cause said valve element to close said inlet port; and
  (VI) a second spring positioned between said first and second pistons to urge said pistons in opposite directions, whereby a force applied to said second piston increases the second spring compressive force tending to urge said first piston in a direction to cause said valve element to open said inlet port, against the action of said first spring, for introducing a pressurized fluid into said second chamber, whereupon such fluid pressure acts via said body passageway against said first piston to urge said first piston in a direction to close said inlet port, against the action of said second spring;

(c) a cam-actuated valve lifter for transmitting a cylinder valve opening force from the engine cam, such force being variable in response to the magnitude of fluid pressure from said fluid pressure regulating valve; and (d) a cylinder valve opening control device for transmitting the opening force from said cam-actuated valve lifter to the cylinder valve, said device comprising:
  (I) a shaft; and
  (II) a cam-like member, rotating about said shaft and having
    A. an outer surface concentric with said shaft along a first section thereof, and
    B. a second section thereof extending from said outer concentric surface and defining:
      (i) a first cam-like surface formed integrally with said outer concentric surface and extending tangentially therefrom, and
      (ii) a second engaging surface, whereby a higher fluid pressure from said fluid pressure regulating valve to said valve lifter causes said lifter to transmit an opening force to said cylinder valve opening control device, the amount of rotation of said device being proportional to said fluid pressure, and whereby the amount the cylinder valve is opened is progressively proportional to the amount of rotation of said cylinder valve opening control device.

3. The system as set forth in claim 2, including a spring mounted with said cylinder valve opening control device for urging said device in a rotational direction opposite that for opening the cylinder valve.

4. The system as set forth in claim 3, further comprising a valve rocker arm disposed between the cylinder valve and said cylinder valve opening control device for transmitting the opening force from said device to the cylinder valve.

5. The system as set forth in claim 4, further comprising a rocker arm push rod disposed between said valve lifter and said cylinder valve opening control device for transmitting the opening force from said valve lifter to said device.

* * * * *